US007334521B2

(12) United States Patent
Moody

(10) Patent No.: US 7,334,521 B2
(45) Date of Patent: Feb. 26, 2008

(54) HAND HELD TWO-ENDED INK STAMPER

(75) Inventor: Brett R. Moody, Corona Del Mar, CA (US)

(73) Assignee: Cosco Industries, Inc., North Mankato, MN (US)

( * ) Notice: Subject to any disclaimer, the term of this patent is extended or adjusted under 35 U.S.C. 154(b) by 289 days.

(21) Appl. No.: 11/066,980

(22) Filed: Feb. 25, 2005

(65) Prior Publication Data

US 2006/0191431 A1 Aug. 31, 2006

(51) Int. Cl.
*B41K 1/04* (2006.01)

(52) U.S. Cl. ..... 101/333; 101/103; 101/405

(58) Field of Classification Search ..... 101/327, 101/333, 334, 405, 406, 103, 104, 109, 368
See application file for complete search history.

(56) References Cited

U.S. PATENT DOCUMENTS

| | | | | |
|---|---|---|---|---|
| 261,229 | A | 7/1882 | Hill | |
| 2,784,668 | A | 3/1957 | Poje | |
| 4,452,142 | A | 6/1984 | Eckels | |
| 4,854,235 | A | 8/1989 | Lyon | |
| 4,939,990 | A | 7/1990 | Inaguma et al. | |
| 5,743,185 | A | 4/1998 | Hippely et al. | |
| 6,499,398 | B2 * | 12/2002 | MacNeil | 101/327 |
| 6,615,719 | B1 | 9/2003 | Winston | |
| 7,066,089 | B1 * | 6/2006 | Shih | 101/334 |

FOREIGN PATENT DOCUMENTS

| | | |
|---|---|---|
| JP | 2003-001916 | 1/2003 |
| WO | WO 99/28132 | 6/1999 |
| WO | WO 2004/091923 | * 10/2004 |

* cited by examiner

*Primary Examiner*—Daniel J. Colilla
*Assistant Examiner*—Kevin D. Williams
(74) *Attorney, Agent, or Firm*—Moore & Hansen, PLLP; Peter R. Forrest

(57) ABSTRACT

A two-ended ink stamper has at least one handle with at least two ends. A first frame and a second frame are provided, and each frame is disposed adjacent to a different one of the ends of the handle. Each frame extends in a different direction from the handle. At least two platens are respectively operatively attached to, and disposed within, one of the frames for selective movement within the frame between a non-marking position and a marking position. Each platen is secured to the handle and extends outward from a different end of the handle. Thus, moving the handle moves the platens relative to the frames and between non-marking and marking positions.

11 Claims, 6 Drawing Sheets

HAND HELD TWO-ENDED INK STAMPER

TECHNICAL FIELD OF THE INVENTION

The invention relates generally to hand held ink stampers, and more particularly to a single ink stamper that provides multiple stamp designs.

BACKGROUND OF THE INVENTION

Conventional hand-held, pre-inking ink stampers, like that disclosed by U.S. Pat. No. 6,499,398 issued to MacNeil, have a handle fixed to a platen holding an ink stamp die on the bottom of the platen. The platen is mounted within a frame or cover with an open bottom. The handle is positioned above the frame so that pushing the handle downward pushes the platen and stamp die downward and toward the open bottom of the frame in position to stamp whatever surface the frame bottom is abutting.

The pre-inking stampers, however, are limited because they can only provide a single stamping surface at one end of the stamper. A stamp die providing a different design or color needs to be provided by a separate stamper or the present stamper must be disassembled and reassembled with the new desired stamp die.

Thus, it is an object of the present invention to provide a hand-held ink stamper that provides more than one stamp die in order to provide alternative stamp designs or colors on a single ink stamper without the need for disassembly of the ink stamper.

These and other objects and advantages will be apparent from the following specification.

SUMMARY OF THE INVENTION

The problems mentioned above are solved by the present invention in which a two ended ink stamper has at least one handle with at least two ends. A first frame and a second frame are provided, and each frame is disposed adjacent to a different one of the ends of the handle. Each frame extends in a different direction from the handle. At least two platens are respectively operatively attached to, and disposed within, one of the frames for selective movement within the frame between a non-marking position and a marking position. Each platen is secured to the handle and extends outward from a different end of the handle. Thus, moving the handle moves the platens relative to the frames and between non-marking and marking positions.

In another aspect of the invention, each platen is attached to one of the frames with a resilient member biasing each frame away from the handle so that the platen is biased to the non-marking position.

In yet another aspect of the invention, the handle has interior walls generally shaped in the outline of a "+" to provide support for portions of the platens being inserted into the handle. The interior walls also provide locking grooves for receiving locking ribs on the platens in order to secure the platens to the handle. Finally, the interior walls also have stabilizing fins that abut, and are positioned between, the platens within the handle.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
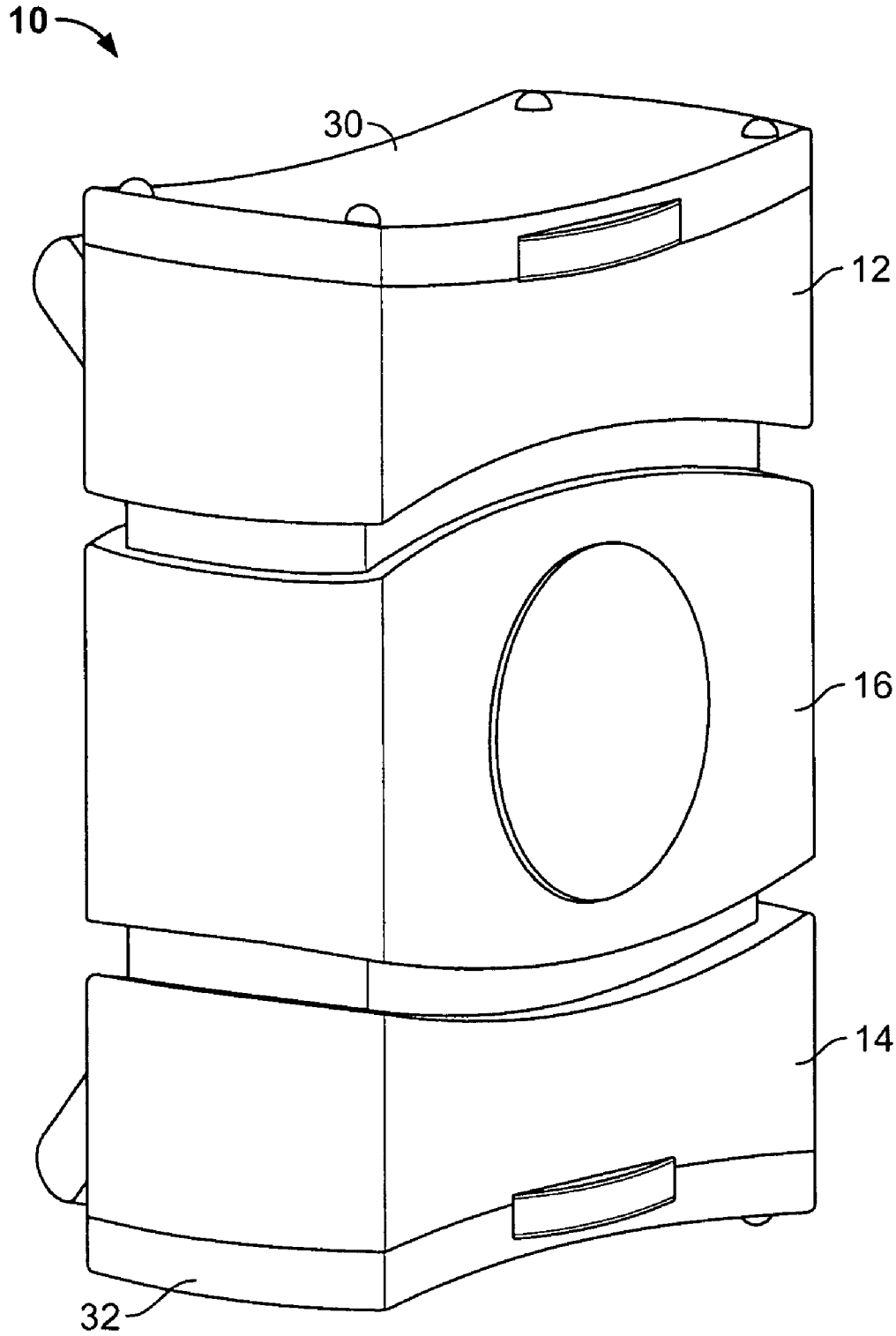
FIG. 1 is a front and right side perspective view of an ink stamper in accordance with the present invention.
Figure 2:
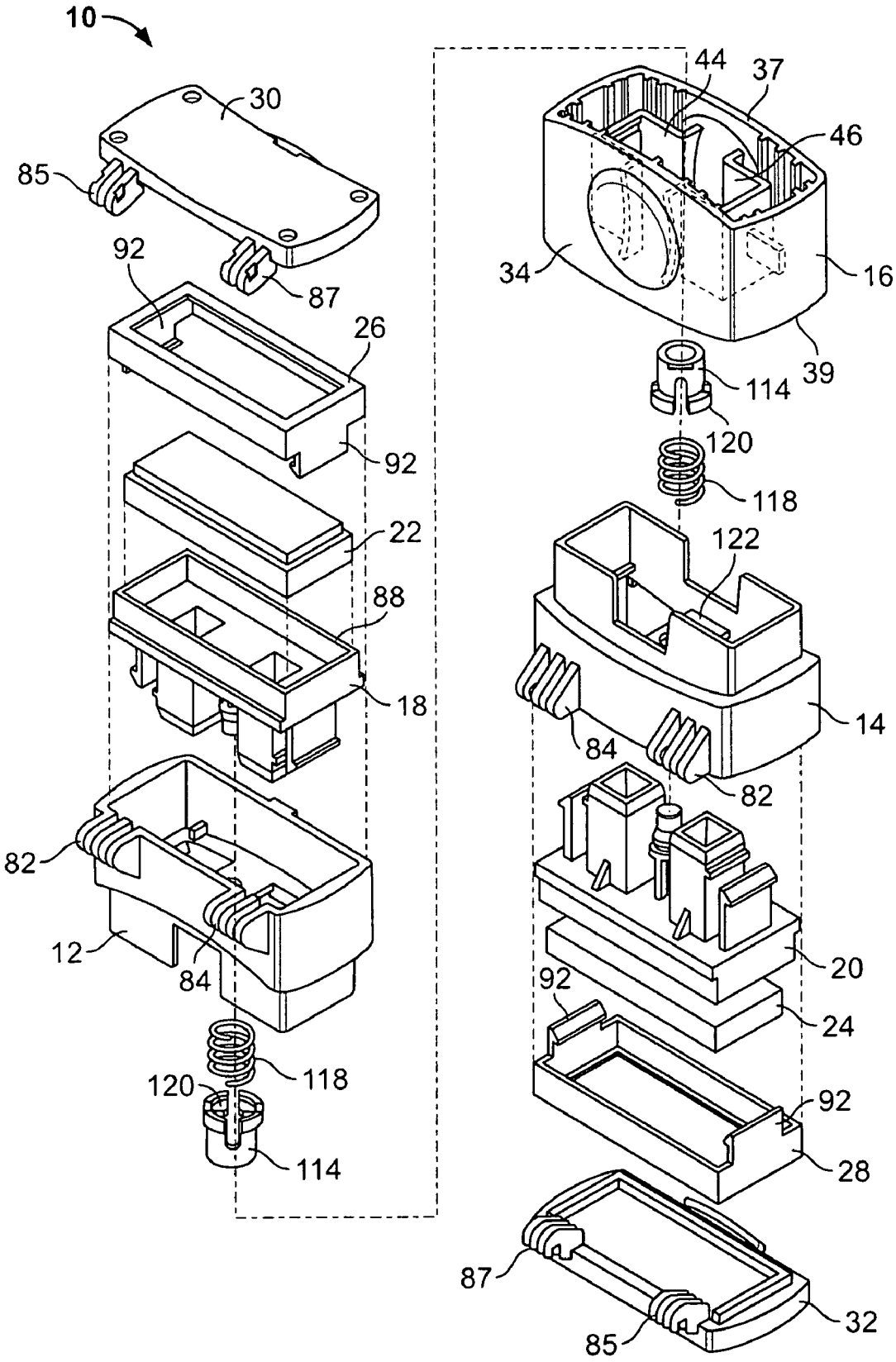
FIG. 2 is an exploded, top and back perspective view of the ink stamper in accordance with the present invention.

Referring to FIGS. 1 and 2, a hand-held, pre-inking stamper 10 has two cases or frames 12, 14 on opposite ends of an actuator or handle 16. Platens 18 and 20 are respectively disposed within a corresponding one of the frames 12 or 14, and each of the platens is fixed to the handle 16. Each platen 18, 20 has a stamp die 22 or 24 and a retaining clip 26 or 28 that clips onto the platen and retains the stamp die on the platen. The stamp dies 22, 24 are any known die, including those made of gels or ink refillable porous materials, and is not limited to any shape as long as it positions a stamp with a marking design at the face of retainers 26, 28. A hinged lid 30, 32 is connected to the frame 12 or 14 to selectively cover the stamp dies.

Figure 3:
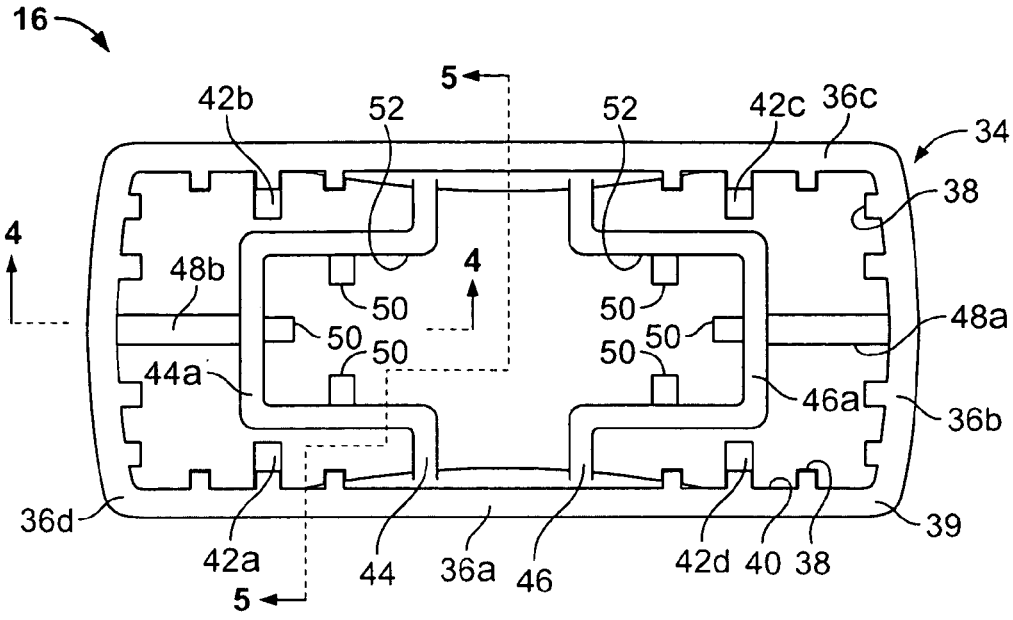
FIG. 3 is a plan view of a handle of the ink stamper in accordance with the present invention.
Figure 5:
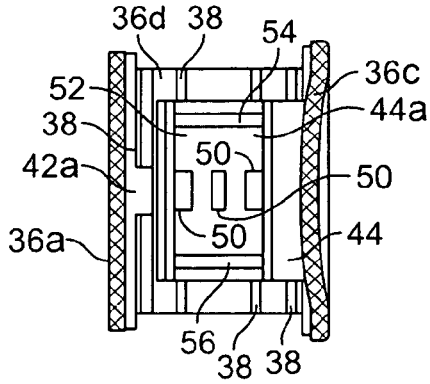
FIG. 5 is a cross sectional view of the handle taken along line V-V on FIG. 3 in accordance with the present invention.

Referring to FIGS. 2 and 3, the handle 16 has a generally tubular body 34 with four exterior walls 36*a-d* generally forming a rectangle, an open top end 37 and an open lower end 39. Each exterior wall 36*a-d* has vertically extending ribs 38 on an interior surface 40 of the exterior walls for guiding the handle as it slides on the frames 12 and 14. As shown in FIGS. 3 and 5, four of the ribs 38 have lateral protrusions 42*a-d* which cooperatively act as a stopper against the frames 12 or 14 moving into the handle.

Handle 16 also has bending interior walls 44, 46 that, cooperatively with front and back walls 36*a*, 36*c*, form the outline of a "+" shape as shown in FIG. 3. The interior walls are shaped this way in order to provide support for portions of the platens 12, 14 inserted into, and connecting to, the handle. The interior walls 44, 46 extend from front and back exterior walls 36*a* and 36*c* of the handle, and each has a main brace 48*a*, 48*b* extending respectively from exterior sidewalls 36*b* and 36*d* to interior sidewalls 44*a*, 46*a*.

Figure 4:
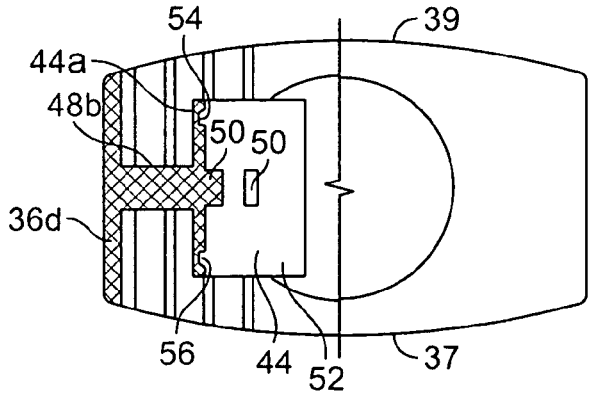
FIG. 4 is a cross sectional view of the handle taken along line IV-IV on FIG. 3 in accordance with the present invention.

As illustrated in FIGS. 3-5, the interior walls 44, 46 have a plurality of stabilizer fins 50 extending inwardly and laterally from an interior surface 52. The stabilizer fins 50 sit vertically between, and abut, the two platens 18 and 20 when the platens are fixed to the handle (see FIG. 10).

As shown in FIGS. 4 and 5, handle 16 also provides horizontally extending locking grooves 54, 56 respectively near the upper and lower ends of both interior sidewall 44 and 46 (interior sidewall 44*a* is shown and sidewall 46*a* has the same grooves). The grooves 54, 56 receive locking ribs 106 or 108 extending from the platens 18, 20 as explained below with regard to FIGS. 8 and 9.

Figure 6:
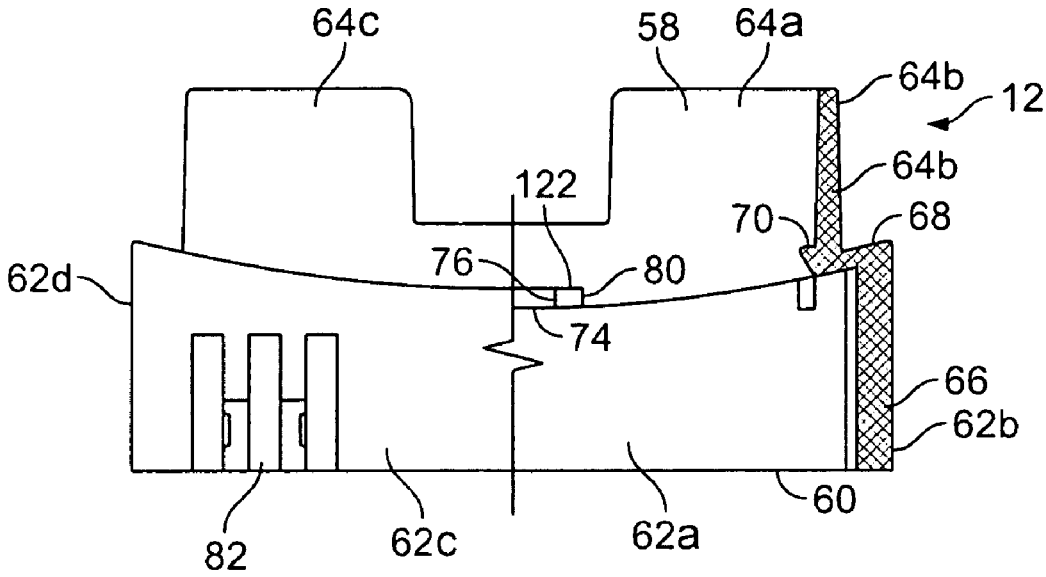
FIG. 6 is an elevational back view of a frame of the ink stamper shown partially in cross section in accordance with the present invention.
Figure 7:
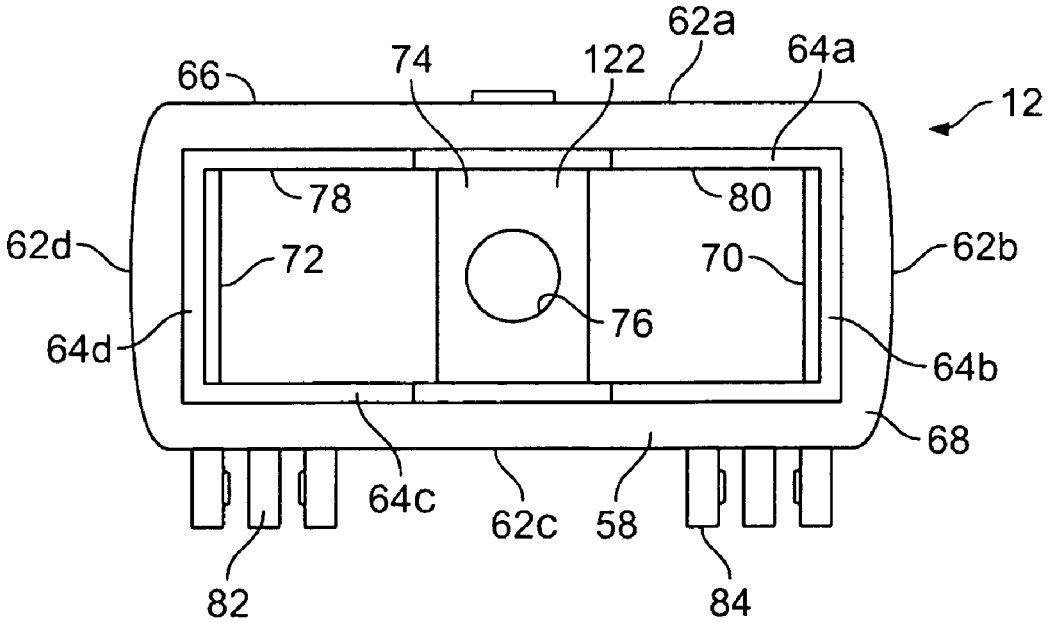
FIG. 7 is a top plan view of the frame of the ink stamper in accordance with the present invention.

Referring to FIGS. 6 and 7, frame 12 shown (frame 14 is the same) has a generally rectangular body 58 with an open bottom end 60 formed by four walls 62*a-d*. Each wall 62*a-d* has an upper portion 64*a-d* pushed back from an outer periphery 66 and dimensioned to slide within handle 16 from the handle's upper and lower open ends 37, 39 (see FIGS. 2 and 4). The upper portions 64*a-d* are shaped to avoid the interior walls 44, 46 of the handle 16. A shoulder 68 connects the outer periphery 66 to the upper wall portions 64*a-d*. Two of the upper portion sidewalls 64*b*, 64*d* has a laterally and horizontally extending stopper ledge 70, 72 extending inward where the upper portion sidewalls meet the shoulder 68. These ledges 70, 72 prevent unintentional separation of the platens 18, 20 from the frames 12, 14 as explained below.

Referring to FIG. 7, a bridge 74 spans from the front wall 62*a* to the back wall 62*c* at the height of shoulder 68. The bridge 74 has a circular aperture 76 in the center. The bridge 74 and sidewalls 62*a-d* cooperatively define two square openings 78, 80. The aperture 76 and openings 78, 80, respectively, receive pin 112 and towers 102 and 204 from the platen 18 or 20 (See FIGS. 8-10). The back wall 62*c* has a pair of hinge brackets 82, 84 to respectively connect to hinge brackets 85, 87 on the lid 30 or 32 as shown on FIG. 2.

While the frame 12 or 14 is shown with solid walls, it will be appreciated that as long as a frame piece operates to at least provide a distal bottom or top edge of the ink stamper so that the platen and stamp die can be positioned at particular distances from this edge for defining a marking and non-marking position, then such a frame still falls within the scope of the present invention. This distal edge is typically placed against the surface to be marked but need not be. Thus, the frame 12 or 14 may actually only cover a portion of the platens or may simply be made of structural beams and columns.

Figure 8:
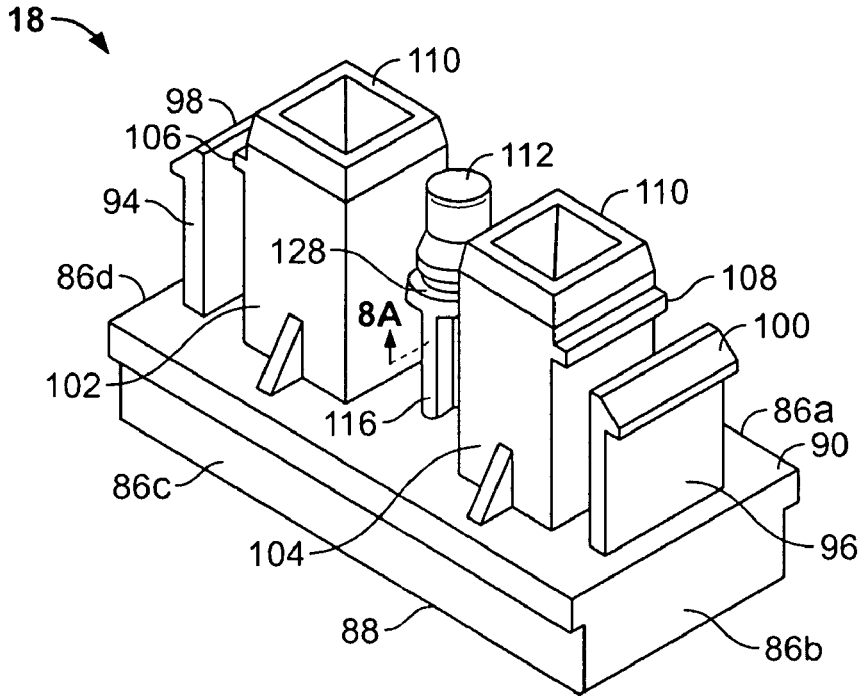
FIG. 8 is a top and side perspective view of a platen for the ink stamper in accordance with the present invention.
Figure 9:
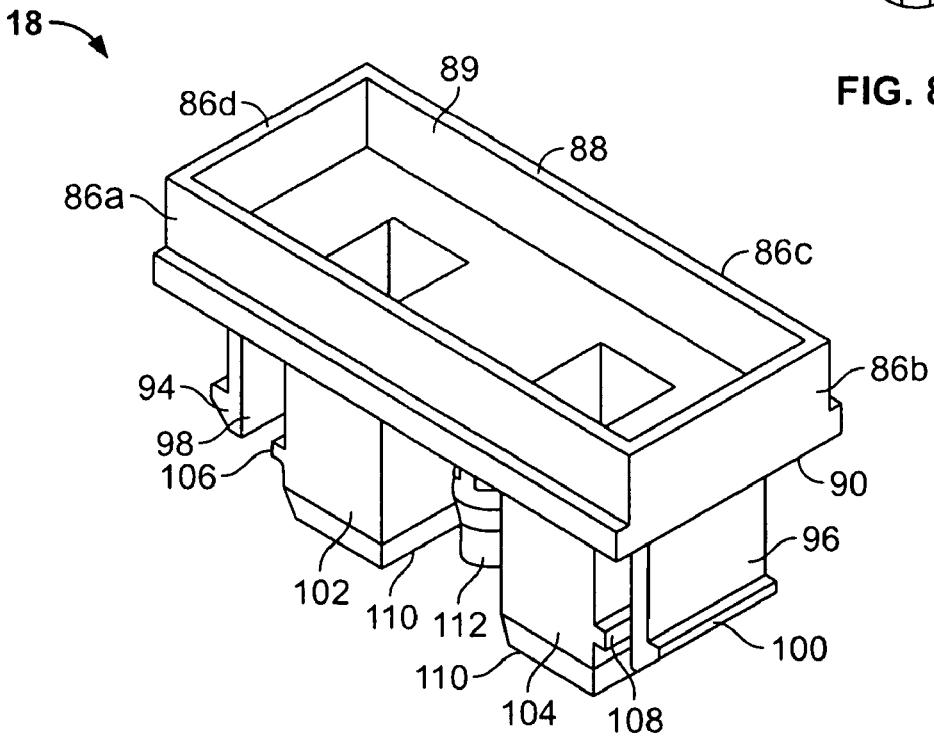
FIG. 9 is a bottom and side perspective view of a platen for the ink stamper in accordance with the present invention.

Referring to FIGS. 8 and 9, platen 18 (and similarly platen 20) has four walls 86*a-d* defining an open, rectangular, bottom end 88 (also referred to as the far end of the platen relative to its position on the handle 16) and a top wall 90. The height of clips 92 (shown on FIG. 2) on the stamp die retainer 26 or 28 corresponds to the height of sidewalls 86*b* and 86*d* to provide a snug fit that locks the retainer to the bottom end 88 of the platens 18 or 20.

As illustrated in FIGS. 8 and 9, two resilient stopper tabs 94, 96 extend upward from top wall 90 and have widened pointed tips 98, 100. The distance between tab 94 and tab 96 corresponds to the distance between stopper shoulders 70 and 72 on frames 12 and 14 so that tabs 94, 96 must be squeezed slightly inward in order to mount the platen 18 in the corresponding frame. Once the tips 98, 100 are placed interiorly of the shoulders 70, 72, the tabs can be released, and the platen will not disengage from the frame 12 or 14 unless the tabs 94, 96 are squeezed again since the tips 98, 100 will respectively engage the shoulders 70, 72 blocking further motion of the platen toward the bottom end 60 of the frame.

As also illustrated in FIGS. 8 and 9, platen 18 also has two chimneys or towers 102, 104 extending upward from top wall 90 and are open at the top wall 90 in order to provide access to the back of a stamp die 22 or 24 sitting within a main chamber 89 of the platen 18 for reloading of ink. A horizontally extending locking rib 106, 108 protrudes from opposite sides near the top of the two towers 102, 104. These ribs are snapped into grooves 54 or 56 on the handle 16 as shown on FIG. 12.

With this structure in mind, it will be understood that each square opening 78 and 80 on the frame 12 or 14 (shown on FIG. 7) provides access to the upper portion of the frame for one of the towers 102 or 104, and one of the stopper tabs 94 or 96. It will also be understood that interior walls 44, 46 of the handle 16 (shown in FIG. 3) are shaped to avoid, and in one embodiment abut, the two towers 102, 104. As explained above, the top edges 110 of the towers are pressed against the stabilizing fins 50 (shown in FIGS. 3 and 10) of the handle when the platens 12, 14 are secured to the handle.

Figure 8A:
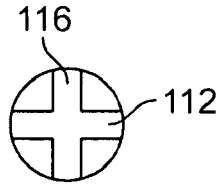
FIG. 8A is cross sectional view of a portion of the ink stamper taken along the line 8A-8A on FIG. 8.

As shown in FIGS. 8 and 9, platen 18 also includes a mounting pin 112 extending upward generally from the center of top wall 90. The shaft 116 of the pin is "X" shaped as shown in FIG. 8A and has a diameter to fit through aperture 76 on the frame 12. The top of the pin is shaped to receive a cap 114 (shown in FIGS. 2 and 10) that snaps onto the pin. For this purpose, the cap 114 has an annular inner rib 126 (shown on FIG. 10) for snapping into an annular groove 128 (shown on FIG. 8) near the top of pin 112.

Figure 10:
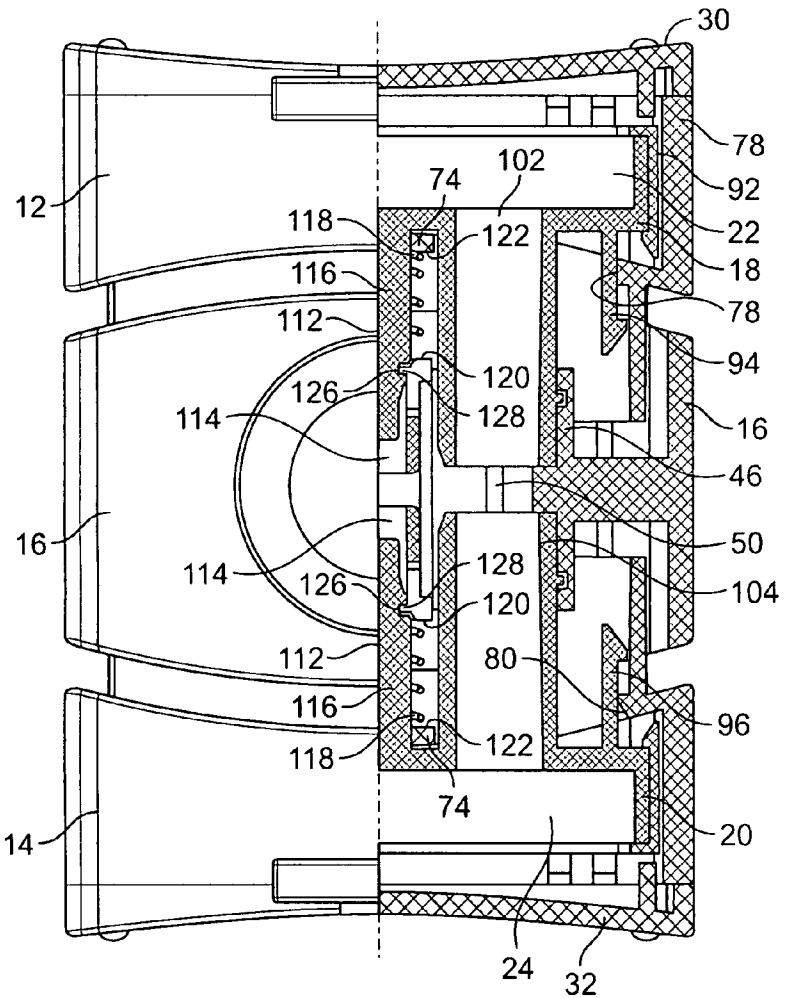
FIG. 10 is a front view of the ink stamper shown partially in cross section in accordance with the present invention.

Referring to FIGS. 2 and 10, a resilient member such as a coil spring 118 is wound around the shaft 116 of the pin 112 and is compressed between a bottom edge 120 of the cap 114 and a top surface 122 of the bridge 74 on the frame 12 or 14. This structure biases the platen 18 away from the frame's bottom end 60. In other words, each platen is biased to the "non-marking" position.

Figure 11:
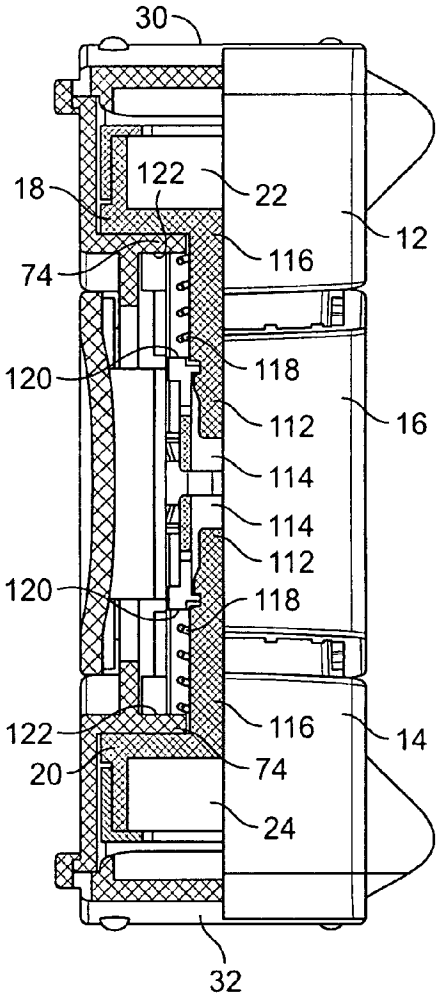
FIG. 11 is a right side view of the ink stamper shown partially in cross section in accordance with the present invention.

Referring to FIGS. 10-11, in order to operate the ink stamper 10, the lid 30 or 32 over the stamp die 22 or 24 with the desired stamp design is opened and the corresponding frame 12 or 14 is placed against the surface to be marked. The handle 16 is then pushed toward that end of the frame and the surface to be marked. This action moves the "marking" platen toward the open distal end 60 of the frame 12 or 14 on the marking end of the ink stamper (the "marking frame") and overcomes the force of the spring 118 and compresses it. Once the mark is made and the handle 16 is released, the force of the spring 118 forces the platen back away from the frame end 60 and away from the surface that was marked.

While this marking action proceeds, both the platen 18 or 20, spring 118 and the frame 12 or 14 on the opposite end of the ink stamper (the "non-marking" side) are pulled inward while maintaining their positions relative to each other (i.e. the spring on the non-marking side is not compressed or expanded since the non-marking frame is free to move inward with the non-marking platen).

While a single handle 16 is shown, it will be appreciated that multiple handles could be used, for example, by splitting handle 16 so that "half" a handle would move for either side while the other half a handle would remain still on the "non-marking" side.

It will also be appreciated that more than two platens and stamp dies can be attached to a single handle in a wheel type of configuration.

While the preferred embodiments of the invention have been shown and described, it will be apparent to those skilled in the art that changes and modifications may be made therein without departing from the spirit of the invention, the scope of which is defined by the appended claims.

What is claimed is:

1. A two-ended ink stamper, comprising: at least one handle having at least two ends; a first frame and a second frame, each of said frames disposed adjacent to a different one of said ends of said handle and extending in a different direction from said handle; and at least two platens, each platen being operatively attached to, and disposed within, one of said frames for selective movement within said frame between a non-marking position and a marking position, each said platen being secured to said handle and extending outward from a different said end of said handle, wherein moving said handle moves said platens relative to said frames and between said non-marking and marking positions; wherein each said platen is attached to one of said frames with a resilient member biasing each said frame away from said handle for biasing said platen in said non-marking position; wherein each said frame has a top wall defining an opening, and wherein each said platen has a top wall with a pin disposed through said opening, said pin having a top cap, the ink stamper further comprising a resilient member compressed between said top cap and said top wall of said frame.

2. The stamper of claim 1, wherein said top cap is removable from said pin.

3. The stamper of claim 1, wherein each platen has a top wall and at least one tab extending generally perpendicular from said top wall toward said handle, said tab(s) having a hooked top, and wherein said frame has a locking shoulder for each tab running generally parallel to said top wall of said platen for engaging said hooked top of said tab to prevent unintentional separation of said platen from its corresponding said frame.

4. The stamper of claim 1, wherein each said platen has a far end relative to said handle, the stamper comprising a stamp die retained on each said far end of each said platen, and wherein each said frame has an open distal end, said platen and said stamp die being moved toward said distal open end for said marking position and kept back from said distal open end for said non-marking position for each said platen and frame.

5. The stamper of claim 4, comprising a retainer clipped onto each said platen for maintaining said stamp dies on each said platen.

6. The stamper of claim 4, comprising a lid selectively covering each said open distal end of said frames.

7. A two-ended ink stamper, comprising: at least one handle having at least two ends; a first frame and a second frame, each of said frames disposed adjacent to a different one of said ends of said handle and extending in a different direction from said handle; and at least two platens, each platen being operatively attached to, and disposed within, one of said frames for selective movement within said frame between a non-marking position and a marking position, each said platen being secured to said handle and extending outward from a different said end of said handle, wherein moving said handle moves said platens relative to said frames and between said non-marking and marking positions; wherein said platens each generally define a plane, and wherein said handle has a plurality of interior walls extending generally perpendicular to said plane; and wherein said handle includes stabilizing fins extending from said interior walls, each said platen having a top wall and towers extending from said top wall, each said tower having a distal end, said towers fitting within said interior walls and abutting said stabilizing fins.

8. The stamper of claim 7, wherein said interior walls generally form the outline of a "+" shape in top plan view.

9. The stamper of claim 7, wherein said stabilizing fins have opposite ends, and wherein said platens have said towers abutting said stabilizing fins on both said opposite ends.

10. A two-ended ink stamper, comprising: at least one handle having at least two ends; a first frame and a second frame, each of said frames disposed adjacent to a different one of said ends of said handle and extending in a different direction from said handle; and at least two platens, each platen being operatively attached to, and disposed within, one of said frames for selective movement within said frame between a non-marking position and a marking position, each said platen being secured to said handle and extending outward from a different said end of said handle, wherein moving said handle moves said platens relative to said frames and between said non-marking and marking positions; wherein said platens each generally define a plane, and wherein said handle has a plurality of interior walls extending generally perpendicular to said plane; wherein said interior walls have opposing upper and lower ends, each end defining an elongated groove, each said platen having a top wall and towers extending from said top wall, each said tower having an elongated lip for engaging said grooves on said interior wall of said handle from opposite sides of said handle.

11. The stamper of claim 10, wherein said interior walls generally form the outline of a "+" shape in top plan view.

* * * * *